US006394082B1

(12) United States Patent
Rhynsburger

(10) Patent No.: US 6,394,082 B1
(45) Date of Patent: May 28, 2002

(54) ASH RETAINER AND GRILL SUPPORT

(76) Inventor: Rennie R. Rhynsburger, 1475 W. 300 South, Salt Lake City, UT (US) 84104

( * ) Notice: Subject to any disclaimer, the term of this patent is extended or adjusted under 35 U.S.C. 154(b) by 0 days.

(21) Appl. No.: 09/756,518

(22) Filed: Jan. 9, 2001

(51) Int. Cl.[7] ..... F23J 1/00
(52) U.S. Cl. ..... 126/243; 126/25 R
(58) Field of Search ..... 126/25 R, 9 R, 126/242–245, 41 R, 38, 40, 9 B, 50; 110/166; 220/571, 4.04, 4.08, 2; D7/403

(56) References Cited

U.S. PATENT DOCUMENTS

| | | | | | |
|---|---|---|---|---|---|
| 226,800 | A | * | 4/1880 | Smith | 110/166 |
| 3,172,402 | A | * | 3/1965 | Valiela | 126/245 |
| 3,851,731 | A | * | 12/1974 | Schulze | 126/25 R |
| 4,628,901 | A | * | 12/1986 | Poulos | 126/243 |
| 5,036,832 | A | * | 8/1991 | Schlosser | 126/25 R |
| 6,119,679 | A | | 9/2000 | Galvin | |

* cited by examiner

*Primary Examiner*—James C. Yeung
(74) *Attorney, Agent, or Firm*—Mallinckrodt & Mallinckrodt; Robert R. Mallinckrodt

(57) ABSTRACT

An ash retainer and grill support for supporting a charcoal or similar grill and providing for the collection and storage of the ashes and other debris from the grill so as to aid clean up from the grill, provide increased safety by preventing easy access to hot coals, and to provide containment for the ashes so they can be easily removed from areas that restrict leaving fire remains, includes a bucket like retainer having an open top to receive and support a grill body therein. The normal grill air openings are within the opening so that any ashes or debris falling through such openings fall into and are collected by the retainer. The retainer includes a retainer vent to allow flow of air into the retainer and into the grill. The retainer has a double bottom wall and portion of side wall to insulate the outer wall from hot ashes and coals to reduce the chance of fire and a user being burned. The opening in the retainer is preferably smaller than the grill body so the grill extends from the retainer opening and can be leveled when the retainer is positioned on an unlevel surface.

12 Claims, 3 Drawing Sheets

ASH RETAINER AND GRILL SUPPORT

BACKGROUND OF THE INVENTION

1. Field

Figure 8:
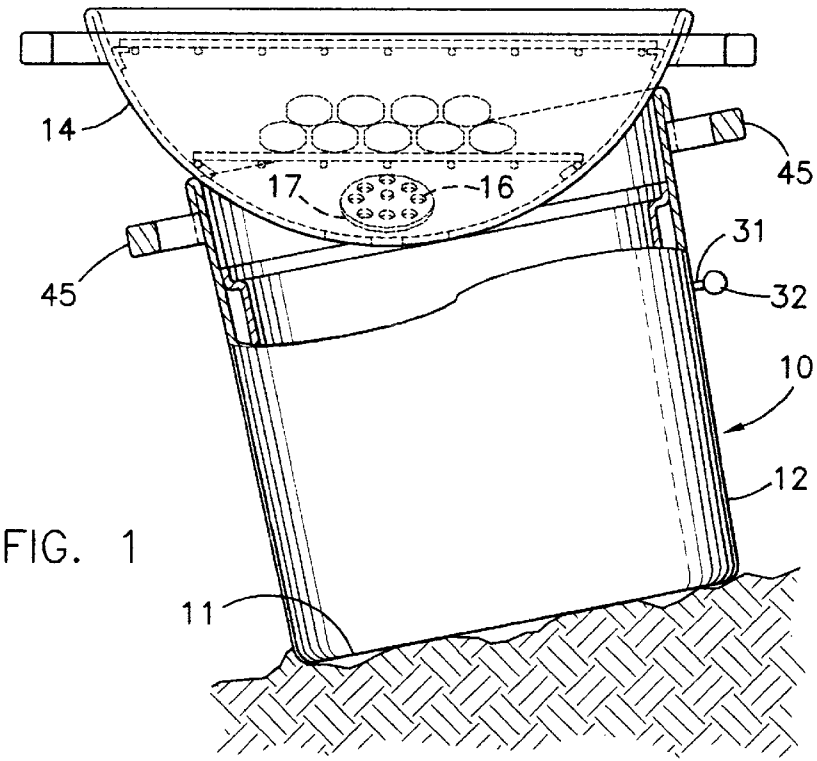

The invention is in the field of camping and picnic equipment and particularly in the field of charcoal cooking grills and of environmental protection by collecting ashes from such grills for removal from a camping or picnic site so as to leave the site as it was found.

2. State of the Art

Concern is rising about leaving evidence of human presence in various areas and rules are going into effect in some areas requiring removal of all evidence of presence or at least certain types of presence, such as evidence of fire shown by fire remains. This requires campers and picnickers to either forgo fires and use of grills, or to clean up all evidence of fires or use of grills in these areas. While some grills can retain ashes inside the grill body, most grills have air holes in the bottom or sides of the grill body to allow combustion air to enter the grill. Without such holes or vents, the fire in the grill does not burn satisfactorily. However, with such holes or vents, ashes fall through such holes and require clean up upon leaving the site. Further, if used extensively on a trip, ashes build up in the grill body and have to be removed. No easy prior art way of retaining ashes for easy removal from a camp or picnic site are known to the inventor.

Grills usually include legs extending from the grill body and generally include an ash collecting plate between the legs. However, such plate does not usually catch all ash falling through the grill air holes so when used on a patio or deck, ashes can fall onto the patio or deck and require clean up. Further, hot coals in addition to ashes can fall through open grill air holes onto the ash collecting plate or a supporting surface such as a patio or deck. This is a fire hazzard when the grill is used on a combustible surface such as a wooden deck, and exposed hot coals can be an attraction for children who can be burned by such coals if they are picked up or otherwise played with.

U.S. Pat. No. 6,119,679 shows a support housing for a portable grill which supports a grill in an open top of the housing and includes a storage compartment in the bottom of the housing below a false bottom located below a grill placed on the housing for storage of lighter fluid and charcoal. The normal legs and ash catching tray remain extending from the bottom of the grill and are received in the housing above the false bottom. Each time the grill is to be used, clamps holding the grill in the housing are released, the grill removed, the false bottom in the housing is removed so that the charcoal and lighter fluid can be removed. After removal of the charcoal and lighter fluid, the false bottom is replaced in the housing and the grill replaced and used in normal manner. After use, the grill must again be removed, the false bottom removed, the charcoal and lighter fluid replaced, the false bottom replaced, and the grill replaced and clamped in place for storage and transportation of the grill and housing as a unit. There is no ash collection and storage in the housing as any ash or other debris falling into the housing will rest on the false bottom and will be removed when the false bottom is removed to allow access to the storage area for the charcoal and lighter fluid. Further, the grill air vents are enclosed by the support, yet the support has no air vents so would appear to restrict air flow into the grill which air flow is generally necessary for a satisfactory fire.

SUMMARY OF THE INVENTION

According to the invention, a bucket like ash retainer and grill support is placed under and as a support for a barbeque grill to catch and retain for easy removal any ashes falling from the grill or removed from the grill. The open top of the ash retainer forms a receiving and supporting opening for a grill body, preferably a rounded or hemispherical grill body. It is preferred that the opening formed by the open top have a diameter less than the diameter of the grill body so that the grill body sits in and extends above the opening in the open top. The grill can then be easily adjusted on the ash retainer and support to be level in uneven terrain.

Grills usually include grill air openings through the grill body so that air can enter the grill below a charcoal or other fuel support grate to supply combustion air to the fire. Ashes and other debris falling through the air openings when open fall into and are collected by the ash collector. After use of the grill, ashes build up in the grill and when built up to a certain level need to be removed to allow air circulation in the grill. Removal of the ashes may be desirable after each use or after several uses. With the invention, the ashes in the grill can be moved over open grill air openings to fall into the ash retainer of the invention, or the grill can be removed and the ashes removed from the grill by tipping the grill to dump the ashes into the ash retainer or by removing the ashes with a smaller container and dumping them into the ash retainer. Thus, ashes from the grill are deposited directly into the ash retainer of the invention and build up therein. The ash holding capacity of the ash retainer is much greater than the ash holding capacity of the grill so ashes from many uses of the grill can be retained in the ash retainer. Generally the capacity will be more than enough to hold the ashes generated during a normal camping trip of a week or more. The retainer is carried from the site of use with the ashes and the ashes are disposed of in proper manner in an appropriate location. The ash retainer preferably includes a double wall across the bottom and partially up the sides to insulate the outer surface from any hot coals or ashes that fall or are placed therein. This reduces fire danger and the danger of the user being burned by the retainer.

The ash retainer and support also includes a container vent which allows air flow into the ash retainer and then through the grill air holes into the grill to support a fire in the grill. Preferably, the container vent is closeable and adjustable so air flow to the grill can be adjustably regulated or closed to control air flow to the grill.

THE DRAWINGS

Figure 1:
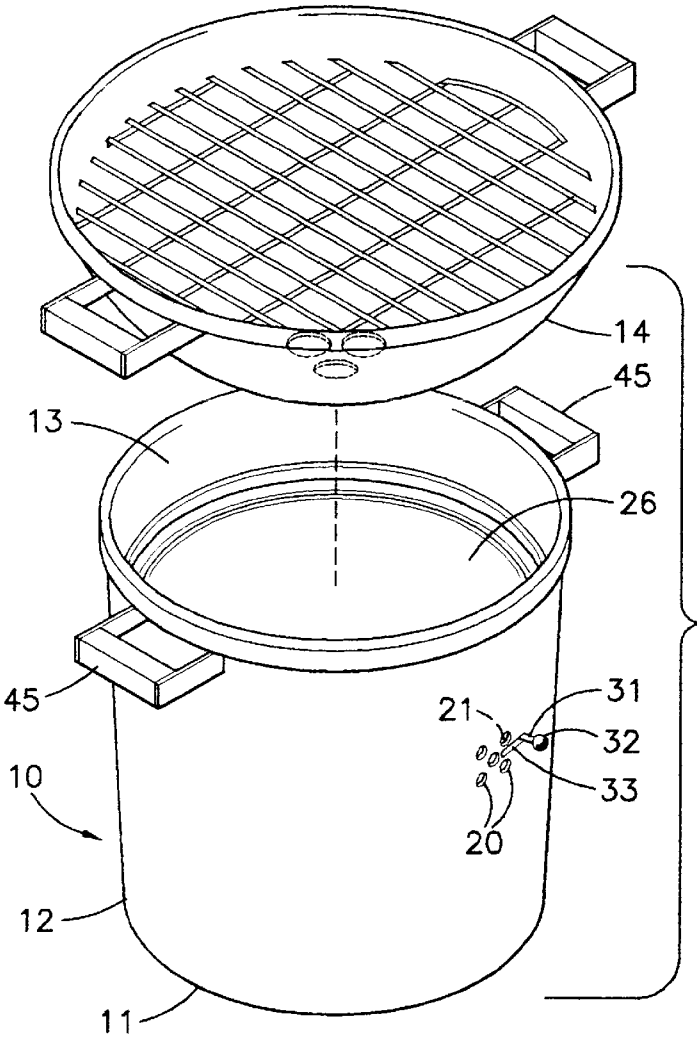
Figure 2:
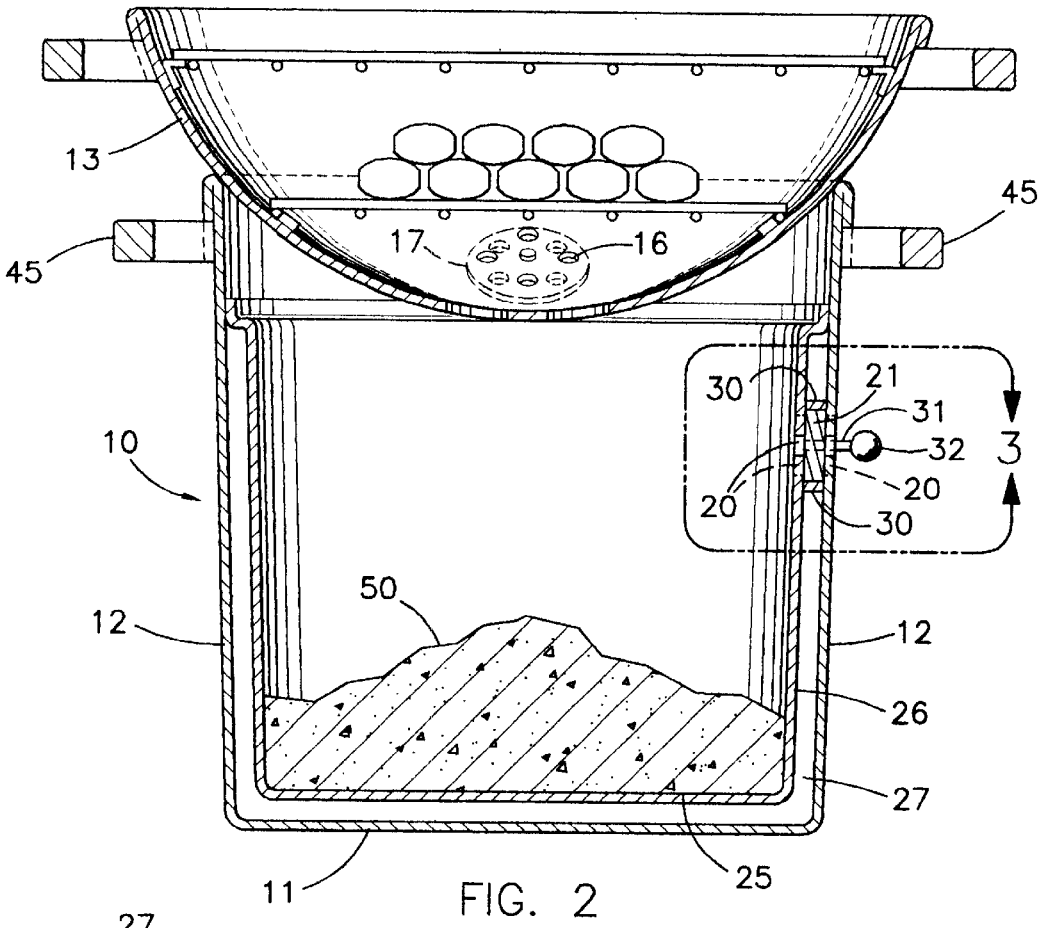
Figure 3:
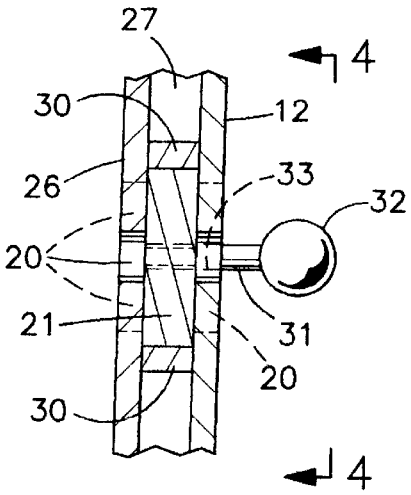
Figure 4:
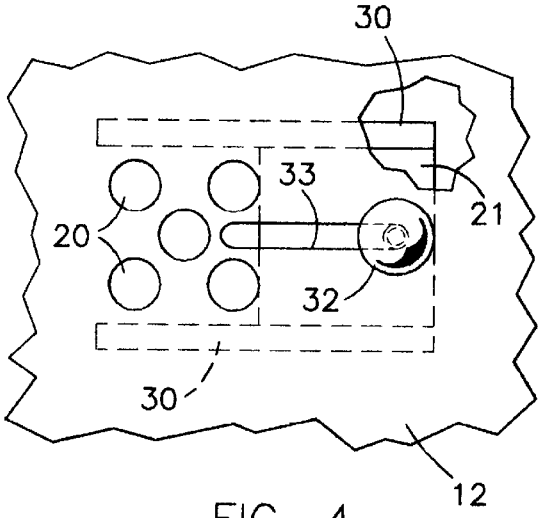
Figure 5:
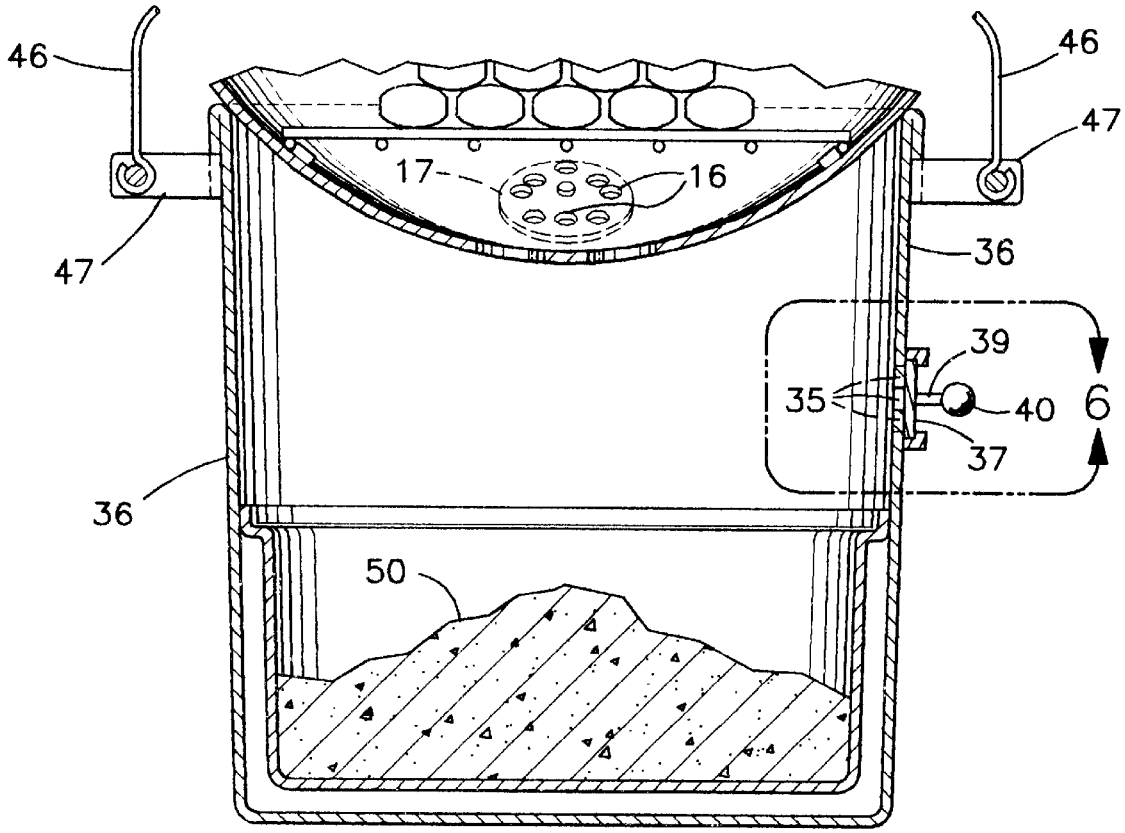
Figure 6:
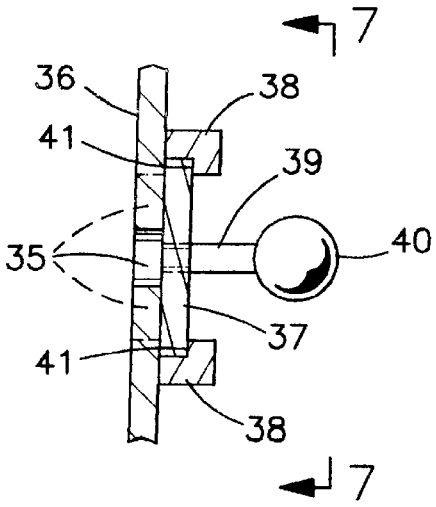
Figure 7:
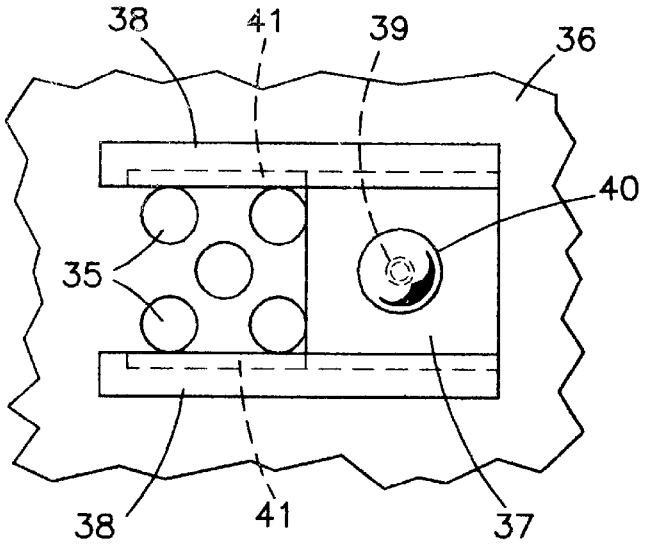

In the drawings which show the best mode presently contemplated for carrying out the invention, FIG. 1 is a pictorial assembly view of the invention showing the grill support of the invention and a grill being used with the support;

FIG. 2, a vertical section through the grill support and grill of FIG. 1;

FIG. 3, an enlargement of the portion of FIG. 2 enclosed by the arrow 3—3;

FIG. 4, a fragmentary vertical elevation of the portion of the grill support shown in FIG. 3 and taken on the line 4—4;

FIG. 5, a vertical section similar to that of FIG. 2 showing a different embodiment of support vent and handle;

FIG. 6, an enlargement of the portion of FIG. 5 enclosed by the arrow 6—6;

FIG. 7, a fragmentary vertical elevation of the portion of the grill support shown in FIG. 6 and taken on the line 7—7; and FIG. 8, a side elevation of the grill support and grill shown in FIG. 1, with the grill support on sloped ground to illustrate the leveling feature of the invention.

DETAILED DESCRIPTION OF THE ILLUSTRATED EMBODIMENT

The ash retainer and grill support of the invention provides a support for a grill and a container for collecting the ashes and other debris from the grill for later disposal or transport from the site of use of the grill to an appropriate disposal area. In a preferred embodiment, the retainer 10 includes a bottom 11 and side walls 12. The container has an open top with top opening 13 formed by side walls 12. In the embodiment shown, the retainer is bucket like with a round opening 13. The retainer shown is best used with a grill having a rounded or hemispherical body 14. Such grills are available from the Weber Company in Palatine, Ill. Such a grill has a similarly shaped top, not shown, that fits over and covers grill body 14. The normal supporting legs for the grill are removed and not used when using the support of the invention which takes the place of the legs and ash collecting plate normally mounted between the legs. The ash retainer top opening 13 has a diameter less than the expected diameter of the grill to be used with the retainer so that only a portion of the grill fits into the opening as shown. However, the opening should be large enough so that the normal grill air vents 16 with adjustable closures, here shown as rotatable discs 17, fit within the retainer and support. The grill air vents 16 should be substantially fully open when the grill is placed in the support and air flow to the grill is then controlled by retainer air vents 20 and adjustable closures 21.

An inner retainer wall made up of inner bottom wall 25 and inner side wall 26 form a double wall bottom and side portion of the retainer. This double wall portion of the retainer insulates the outside bottom and side walls 11 and 12 from hot coals and ashes that may be placed in the retainer. The space 27 between the walls may be an insulating air space or may have insulation such as fiberglass insulation therein. The double wall construction allows hot ashes and coals to be placed in the retainer without the outside walls of the retainer getting dangerously hot to start a fire or burn a user. The double walls may extend up the side walls 12 to any desired degree. FIGS. 1 and 2 show the double wall extending almost to the top of the side wall while FIG. 5 shows the double wall extending only part of the way up the wall.

The retainer and support includes retainer vents 20 shown in FIGS. 1 and 2 as extending through the double side walls 12 and 26. A slide valve is provided by slide closure 21 which slides in a track formed by wall spacers 30, FIGS. 2, 3, and 4. A slide arm 31 with enlarged end 32 extends from slide closure 30 through slot 33 in outside wall 12 so that it can be slid to open or close to any desired extent the retainer vents 20. The extent of travel of the slide closure 21 is limited by the length of slot 33. Extreme travel to the right in FIGS. 1 and 4 will fully open retainer vents 20, while extreme travel to the left will fully close retainer vents 20. Since the grill body sits in opening 13 and substantially blocks the opening, the only source of combustion air through grill air openings 16 is the air that comes through retainer vents 20. Air flow to the grill is controlled by controlling air flow through retainer vents 20.

FIG. 5 shows retainer vents 35 through single side wall 36 in an embodiment of the retainer having a double wall extending only partially up the side wall 36. In such instance, slide closure 37 is mounted in tracks 38 so it can be slid to any desired extent over retainer vents 35 to control air flow. Slide arm 39 with enlarged end 40 allows a user to easily grasp and slide closure 37 in tracks 38. Slots 41 in tracks 38 form stops for closure 37 to limit its travel. Enough travel is provided so that the closure can be slid between fully open and fully closed retainer vents, however, travel could be more limited if desired.

While retainer vents through the retainer side walls are shown, other vent arrangements can be used. For example, spacers could be placed around the inner circumference of opening 13 so that the grill body would not tend to close the opening so that air could enter the retainer through the opening around the grill body.

Handles are provided so that a user can pick up and carry the retainer either with the grill therein or without the grill therein. The figs., except FIG. 5, show handles 45 extending from opposite sides of the retainer so the retainer can be picked up and carried by the handles. FIG. 5 shows an embodiment with a bale type handle 46 (only a portion of the handle is shown), such as normally used with buckets, attached by brackets 47 to the retainer for use in picking up the retainer and carrying the retainer. Various other types of handles can be used.

The ash retainer and grill support of the invention can be used as a leveling device for the grill. If the grill is to be used on uneven ground or other uneven surfaces, the construction of the retainer so that the opening 13 is of a lesser diameter than the diameter of the grill to be supported as shown in the drawings provides a ball joint type connection between the grill and the retainer so that, as shown in FIG. 8, the grill can be easily leveled by rotating it in opening 13 until it is level. The retainer does not have to be level in order for the grill to be level.

In use, the grill is placed in the retainer and used in normal manner except that the air is controlled by the retainer vents rather than the grill air holes. Any ashes, coals, or debris that fall through grill air holes 16 fall into the retainer and are collected there. When ashes build up in the grill body, they are emptied into the retainer. This can be done by moving the ashes in the grill so that they fall through the air openings into the retainer or by tipping the grill to dump the ashes into the retainer, or by any other means such as by emptying the ashes with another container or small shovel which picks up the ashes and transfers them to the retainer. The ashes, shown as 50 in FIGS. 2 and 5, build up in the retainer and remain there until they are emptied. The retainer is sized to have sufficient ash holding capacity for an anticipated activity or period of use of the grill, and various size retainers can be provided, not only to provide for varying ash holding capacities, but to fit various sizes and types of grills. The retainer vents will be positioned in the wall of the retainer so as to be above the expected ash level in the retainer. This is so that the ashes will not block the vents.

While the invention has been shown in connection with a round retainer opening and a hemispherical grill body, the retainer can be configured for use with different shapes and types of grills.

Whereas this invention is here illustrated and described with reference to embodiments thereof presently contemplated as the best mode of carrying out the invention in actual practice, it is to understood that various changes may be made in adapting the invention to different embodiments without departing from the broader inventive concepts disclosed herein and comprehended by the claims that follow.

What is claimed is:

1. An ash retainer and support for a grill having a grill body with grill air openings therethrough, comprising:

a closed bottom open top container having side walls forming an open top opening, said open top container adapted to receive and support a grill body with grill air openings within the open top opening;

a container vent to allow flow of air into the container; and an inner container wall portion over the bottom and at least a lower portion of the container walls to form a double wall for a portion of the container.

2. An ash retainer and support for a grill according to claim 1, wherein the top opening is round.

3. An ash retainer and support for a grill according to claim 2, wherein the grill body is hemispherical and has a diameter, and wherein the top opening has a diameter less than the diameter of the grill body to be placed in the opening.

4. An ash retainer and support for a grill according to claim 1, additionally including handles extending from the container.

5. An ash retainer and support for a grill according to claim 1, additionally including a bale type handle secured to the retainer.

6. An ash retainer and support for a grill having a grill body with grill air openings therethrough, comprising:

a closed bottom open top container having side walls forming an open top opening, said open top container adapted to receive and support a grill body with grill air openings within the open top opening;

a container vent to allow flow of air into the container and adjustable from fully open to fully closed conditions; and an inner container wall portion over the bottom and at least a lower portion of the container walls to form a double wall for a portion of the container.

7. An ash retainer and support for a grill according to claim 6, wherein the container vent is in the container side wall.

8. An ash retainer and support for a grill according to claim 7, wherein the double wall extends through a substantial portion of the side wall, the container vent includes openings through the double wall, and a slide valve between the double walls provides the container vent adjustability.

9. An ash retainer and support for a grill according to claim 7, wherein the double wall t extends partially along the side wall, the container vent includes openings through the single wall, and a slide valve provides the container vent adjustability.

10. An ash retainer and support for a grill according to claim 6, wherein the top opening is round.

11. An ash retainer and support for a grill according to claim 6, additionally including handles extending from the container.

12. An ash retainer and support for a grill according to claim 6, additionally including a bale type handle secured to the retainer.

* * * * *